US007011170B2

(12) United States Patent
Ledgerwood, III et al.

(10) Patent No.: US 7,011,170 B2
(45) Date of Patent: Mar. 14, 2006

(54) INCREASED PROJECTION FOR COMPACTS OF A ROLLING CONE DRILL BIT

(75) Inventors: Leroy W. Ledgerwood, III, Cypress, TX (US); Timothy K. Marvel, The Woodlands, TX (US)

(73) Assignee: Baker Hughes Incorporated, Houston, TX (US)

( * ) Notice: Subject to any disclaimer, the term of this patent is extended or adjusted under 35 U.S.C. 154(b) by 171 days.

(21) Appl. No.: 10/690,943

(22) Filed: Oct. 22, 2003

(65) Prior Publication Data

US 2005/0087370 A1 Apr. 28, 2005

(51) Int. Cl.
*E21B 10/16* (2006.01)
*E21B 10/00* (2006.01)

(52) U.S. Cl. ..... 175/432; 175/374
(58) Field of Classification Search ..... 175/331, 175/374, 336, 341, 425, 432

See application file for complete search history.

(56) References Cited

U.S. PATENT DOCUMENTS

| | | | | |
|---|---|---|---|---|
| 3,922,038 | A * | 11/1975 | Scales | 384/95 |
| 4,343,372 | A * | 8/1982 | Kinzer | 175/374 |
| 4,679,640 | A * | 7/1987 | Crawford | 175/374 |
| 5,868,213 | A * | 2/1999 | Cisneros et al. | 175/331 |
| 6,029,759 | A * | 2/2000 | Sue et al. | 175/374 |
| 6,196,338 | B1 * | 3/2001 | Slaughter et al. | 175/331 |
| 6,598,689 | B1 * | 7/2003 | Slaughter et al. | 175/331 |
| 6,601,661 | B1 * | 8/2003 | Baker et al. | 175/341 |
| 2001/0015290 | A1 * | 8/2001 | Sue et al. | 175/374 |
| 2003/0051922 | A1 * | 3/2003 | Baker et al. | 175/374 |
| 2004/0003946 | A1 * | 1/2004 | Yong et al. | 175/371 |
| 2005/0077092 | A1 * | 4/2005 | Yong et al. | 175/374 |

* cited by examiner

*Primary Examiner*—Jennifer H. Gay
(74) *Attorney, Agent, or Firm*—Bracewell & Giuliani LLP

(57) ABSTRACT

An earth boring bit has rolling cones rotatably mounted to the bit legs. Each cone has conical bands extending around the exterior. Holes are formed in each of the bands. Compacts are press-fitted into the holes, each having a cutting tip that projects from the conical band. Flats are formed in the conical bands, each flat extending between adjacent compacts.

17 Claims, 2 Drawing Sheets

INCREASED PROJECTION FOR COMPACTS OF A ROLLING CONE DRILL BIT

FIELD OF THE INVENTION

This invention relates in general to earth-boring rolling cone drill bits, and in particular to depressions milled on the surface of the cone shell between compacts to increase effective compact projection.

DESCRIPTION OF THE PRIOR ART

One type of earth-boring drill bit, particularly for oil and gas wells, has three rotating cones. The cones are mounted on bit legs that extend downward from a bit body. As the bit body rotates, each of the cones rotates about its own axis. Drilling mud pumped down the drill string flows out nozzles on the bit body.

A plurality of teeth are formed on the cones. In the type of bit concerned herein, the teeth are hard metal compacts press-fitted into holes drilled in the cone shell. The compacts are arranged in circumferentially extending rows. Each compact has a cylindrical base and integral cutting tip, the cutting tip protruding from the cone shell.

The lengths of the cutting tips and the density of the compacts within each row vary depending upon the type of formation being drilled. In medium and soft formations, typically the spacing between compacts and the projection of the cutting tips are greater than in hard formation bits. If the projection is too long, then the compacts tend to fracture.

When drilling medium and soft formations with high percentages of clay or shale, the clay can pack between the teeth, resulting in bit balling. Designing the nozzles of the bit properly reduces the tendency to bit ball. However, in some rock formations, the clay material sticks to the bottom of the borehole instead of sticking to the bit. This bottom balling is a result of the shale in the formation and reduces the rate of penetration.

SUMMARY OF THE INVENTION

The bit of this invention has compacts with a slightly increased effective projection. Slightly increasing the effective projection of the compacts significantly increases the rate of penetration in formations that tend to cause bottom balling. The effective projection of the compacts is preferably increased by forming depressions on the cone shell between the holes within a row of compacts. These depressions are preferably milled in the cone shell. Each depression is preferably a flat surface that is located in a plane perpendicular to a radial line from the axis of rotation of the cone.

The flats are located only on the leading and trailing sides on the holes in the preferred embodiment. The inward and outward sides, relative to the axis of the cone, preferably remain conical. Because of the flats, the compacts penetrate slightly deeper before the cone steel comes into contact with the formation or bottom balling material.

DETAILED DESCRIPTION OF THE INVENTION

Figure 1:
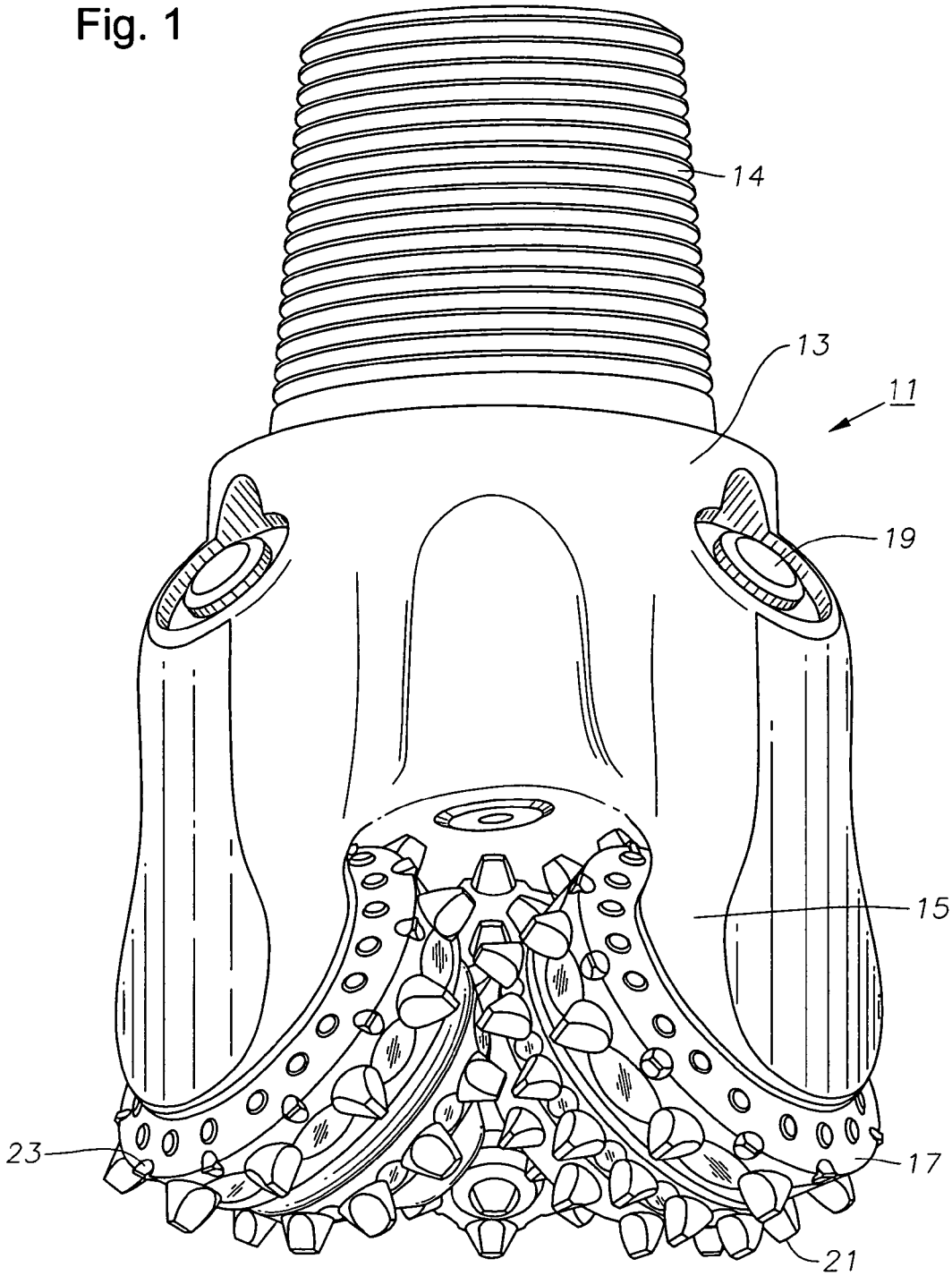
FIG. 1 is a side view of an earth-boring bit constructed in accordance with this invention.

Referring to FIG. 1, bit 11 has a bit body 13 with a threaded section 14 on its upper end for attachment to a drill string. Bit body 13 has at least one bit leg 15, and in this embodiment, three bit legs 15 (only two shown). Bit legs 15 are spaced 120° apart from each about the axis of rotation of bit body 13.

A cone 17 is rotatably mounted to a depending bearing pin (not shown) extending inward from each of the bit legs 15. Cones 17 are generally conical and rotate on lubricated bearings. A lubricant compensator 19 for each bit leg 15 supplies lubricant to the bearings and reduces pressure differential between the lubricant and the hydrostatic pressure on the exterior.

A plurality of compacts 21 are mounted to each cone 17 for disintegrating the earth formation. Compacts 21 are located in circumferential rows that extend around the axis of each cone 17. Bit legs 15 are positioned so that compacts 21 on one cone 17 will intermesh with compacts 21 on adjacent cones 17. The embodiment of FIG. 1 also shows a row 23 of trimmer inserts. Trimmer rows 23 are optional, however and not always utilized.

Figure 2:
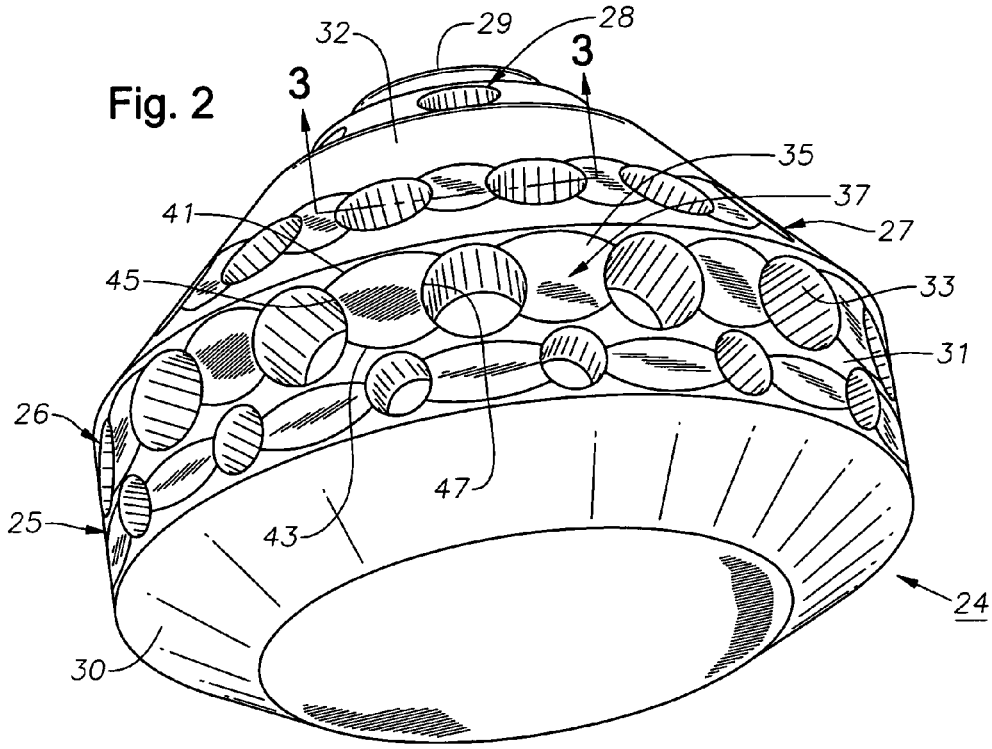
FIG. 2 is an enlarged perspective view of one of the cone shells suitable for the bit of FIG. 1, with the compacts and the trimmer inserts removed.

Referring to FIG. 2, a cone shell 24 that is suitable for one of the cones 17 is shown without its compacts 21 (FIG. 1) and without trimmer row 23. In this example, cone shell 24 has a heel row 25 and a closely space adjacent row 26. Adjacent row 26 is inward from heel row 25 relative to the axis of cone shell 24 and staggered. In this embodiment, the compacts 21 (FIG. 1) for heel row 25 are smaller than adjacent row 26. Cone shell 24 also has an inner row 27 and a nose row 28 in this embodiment, both being inward of adjacent row 26 and closer to cone nose 29 than cone backface 30.

Each row 25, 26, 27 and 28 is located on a conical band 31. Each conical band 31 is milled in the exterior surface of cone 17. A circumferential groove 32 is typically located between two of the conical bands 31 for receiving the intermeshing row of an adjacent cone 17 (FIG. 1). In this embodiment, the outer conical band 31 contains both heel row 25 and adjacent row 26. The other rows 27 and 28 are located on separate conical bands 31.

Referring to FIG. 2, each row 25, 26, 27 and 28 has a plurality of holes 33 for receiving compacts 21. Each hole 33 is a blind cylindrical hole of conventional depth, and each compact 21 (FIG. 1) is of conventional length. In order to increase the effective projection of compacts 21, a depression or flat 35 is formed between holes 33 in at least some of the rows 25, 26, 27 and 28, or all of the rows as shown. Each flat 35 is formed in cone shell 24 in one of the conical bands 31.

Each flat 35 is preferably formed by a milling operation before insertion of compacts 21. Although flats 35 join adjacent holes 33, very little, if any metal is removed at the junction of flat 35 with holes 33. Consequently, hole 33 remains the same depth measured at any point around its sidewall even though flats 35 are only on the leading and trailing sides of holes 33, not on the inward and outward sides. Conical band 31 remains conical on the inward and outward sides of each hole 33 if the diameter of the holes 33 within the particular band 31 is less than the width of the band 31. In some cases, the diameter of the holes 33 is approximately the same as the width of the band 31, thus there is no portion of band 31 on the inward and outward sides.

Figure 3:
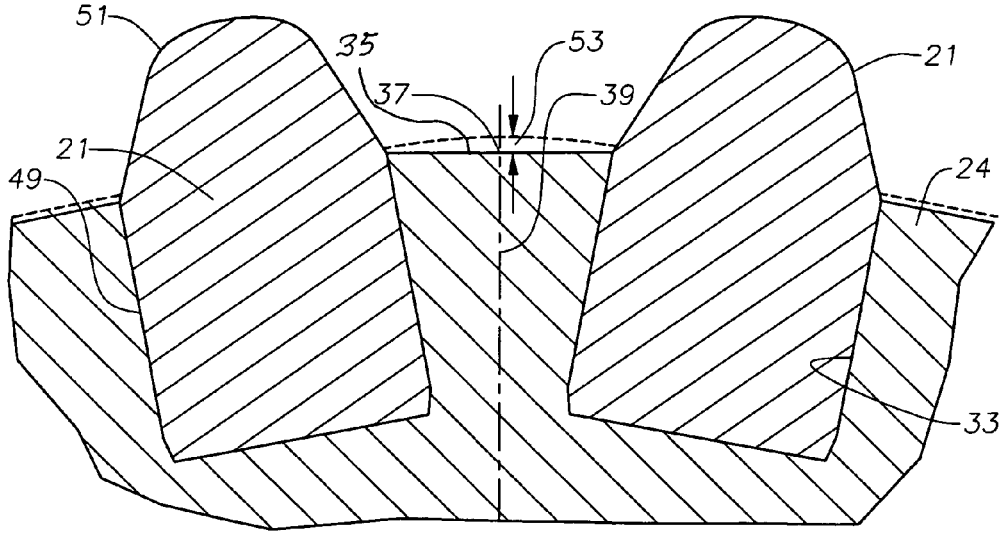
FIG. 3 is a sectional view of a portion of the cone shell of FIG. 2 taken along the line 3—3, but showing two of the compacts installed.

As shown also in FIG. 3, each flat 35 has a midpoint 37 located halfway between two adjacent holes 33. A radial line 39 extending from the axis of rotation (not shown) of cone shell 24 passes through midpoint 37. Each flat 35 is preferably located in a plane that is perpendicular to the radial line 39 that passes through its mid point 37.

As shown in FIG. 2, each flat 37 has a generally elliptical perimeter with an inward edge 41 closer to nose 29 of cone shell 24 than an outward edge 43. Outward edge 43 is closer to backface 30 than nose 29. Inward and outward edges 41, 43 are curved opposite to each other. Each flat 35 also has a leading edge 45 and a trailing edge 47, considering the direction of rotation of cone shell 24. Leading edge 45 and trailing edge 47 intersect adjacent holes 33 in the preferred embodiment. Each flat 35 thus has an elliptical perimeter with a minor axis passing through inward and outward edges 41, 43 and a major axis passing through leading and trailing edges 45, 47. Edges 45, 47 are truncated and concave, rather than convex as would exist in a full ellipse.

The dimension measured along midpoint 37 from inward edge 41 to outward edge 43 is not greater than the width of the conical band 31 containing it. Also, the dimension between inward edge 41 and outward edge 43 is equal or slightly larger than the diameter of holes 33 that are located adjacent to it. The distance from the point that inward edge 41 intersects hole 33 to the point where outward edge 43 intersects the same hole 33, measured along a straight line, is less than the diameter of hole 33. Stated in another manner, the intersection of inward edge 41 with hole 33 to the intersection of outward edge 43 with hole 33 is less than 180°.

Referring to FIG. 3, each compact 21 has a barrel 49 that is cylindrical and press-fitted in one of the holes 33. Each compact 21 is of a hard metal, typically tungsten carbide. A cutting tip 51 is integrally formed with compact 21 and protrudes outward from the exterior surface of cone shell 24. Cutting tip 51 may be of a variety of shapes, such as chisel-shaped as shown or hemispherical, ovoid and the like. The junction of cutting tip 51 with barrel 49 is approximately at the upper edge of each hole 33.

The length of each compact 21 may be the same as the prior art compact. The depth of each hole 33 may be the same as the prior art hole, thus the actual projection of each compact 21 is the same as in the prior art. The removal of conical portions of conical bands 31 to create flats 35, however, increases the effective projection of cutting tip 51. The dotted lines in FIG. 3 represent the exterior of cone shell 24 prior to forming flats 35 (FIG. 2). The difference 53 between the dotted lines and flat 35 creates an effective increase in projection.

As cone shell 24 rotates, if cutting tips 51 fully penetrate the earth, a portion of the exterior of cutter shell 24 between each cutting tip 51 contacts the bottom of the borehole. Because of the removal of material at flats 35, cutting tips 51 are able to penetrate slightly deeper than if the exterior appeared as indicated by the dotted lines of FIG. 3. Similarly, the cutting tips 51 are not fully penetrating the bottom of the borehole, flats 35 make it less likely that the exterior of cone shell 24 will contact the borehole bottom. Tests have determined that even slight increased projection has significantly increased the rate of penetration in certain formations. This is attributed to the compact being able to penetrate through the bottom balling material and engage the formation.

The invention has significant advantages. The effective increased projection increases the rate of penetration in formations subject to bottom balling. The compacts remain the same size as in the prior art, but achieve greater effective projection by the flats. No re-design of the bit is required because the intermesh between compacts on different cones does not change. This effective increased projection does not diminish the toughness of the compacts nor lead to more breakage because the compacts remain the same length and project the same amount.

While this invention has been shown in only one of its forms, it should be apparent to those skilled in the art that it is not so limited but is susceptible to various changes without departing from the scope of the invention. For example, although the flats are shown to be planar, they could be slightly concave.

The invention claimed is:

1. An earth boring bit, comprising:

a bit body having at least one bit leg;

a cone shell rotatably mounted to the bit leg;

at least one circumferential row of compacts mounted in holes in the cone shell and protruding from the cone shell; and a substantially flat depression in the cone shell extending between each of the compacts in the row.

2. The bit according to claim 1, wherein each of the depressions has leading and trailing ends that intersect adjacent ones of the holes.

3. The bit according to claim 1, wherein each of the depressions has a perimeter with inner and outer portions that curve in directions away from each other and leading and trailing portions that curve in directions toward each other, each of the leading and trailing portions intersecting one of the holes.

4. The bit according to claim 1, wherein each of the depressions lies in a single plane from an intersection of one hole with an exterior of the cone shell to an intersection of an adjacent hole in the row with an exterior of the cone shell.

5. The bit according to claim 1, wherein each of the depressions has a generally elliptical perimeter with opposite leading and trailing ends that are that curve toward each other.

6. An earth boring bit, comprising:

a bit body having at least one bit leg;

a cone shell rotatably mounted to the bit leg;

a plurality of holes formed in circumferential rows on conical bands of the cone shell;

a compact mounted in each of the holes; and a plurality of depressions in the cone shell extending between and having leading and trailing ends that intersect adjacent holes in at least one of the rows to increase effective projection of the compacts.

7. The bit according to claim 6, wherein each depression is a flat surface located in a single plane that is perpendicular to a radial line extending from an axis of rotation of the cone.

8. The bit according to claim 6, wherein each of the leading and trailing ends has an axial dimension that is not greater than a diameter of the adjacent holes.

9. The bit according to claim 6, wherein the conical band that contains the depressions has conical portions axially inward and outward of each of the depressions.

10. The bit according to claim 6, wherein the leading and trailing ends of each of the depressions on at least one of the conical bands curve toward each other.

11. The bit according to claim 6, wherein the leading and trailing ends of each of the depressions curve toward each other, and each of the depressions has inward and outward edges that curve away from each other.

12. The bit according to claim 6, wherein the depressions are located in all of the rows on the cone.

13. An earth boring bit, comprising:

a bit body having at least one bit leg;

a cone shell rotatably mounted to the bit leg for rotation about a cone axis;

a plurality of conical bands extending around and formed in an exterior surface of the cone shell;

a plurality of holes extending circumferentially around each of the conical bands;

a plurality of compacts, each of the compacts having a cylindrical barrel mounted in one of the holes and a cutting tip that projects from the conical band; and a plurality of flats formed in at least one of the conical bands, each of the flats having circumferentially spaced-apart ends that intersect adjacent ones of the holes, each of the flats having a midpoint between its ends that is located on a radial line of the cone axis, and each of the flats being located in a single plane perpendicular to its radial line.

14. The bit according to claim 13 wherein each of the ends of each of the flats is curved along a radius that is the same as a radius of the hole that it intersects.

15. The bit according to claim 13, wherein the ends of each of the flats have an axial dimension that is not greater than a diameter of the adjacent holes.

16. The bit according to claim 13, wherein each of the conical bands has conical portions axially inward and outward of each of the holes relative to an axis of rotation of the cone.

17. The bit according to claim 13, wherein each of the holes in the row containing the flats has a constant depth measured at any point around the sidewall of the hole.

* * * * *